United States Patent [19]

Pearson

[11] 3,974,370

[45] Aug. 10, 1976

[54] PREFOCUSED LAMP BASE AND FIXTURE

[75] Inventor: Donald L. Pearson, Moreland Hills, Ohio

[73] Assignee: General Electric Company, Schenectady, N.Y.

[22] Filed: Apr. 10, 1975

[21] Appl. No.: 566,729

Related U.S. Application Data

[63] Continuation-in-part of Ser. No. 506,179, Sept. 16, 1974, abandoned.

[52] U.S. Cl. ..... 240/41 BM; 240/52 R; 339/144 R; 29/25.13

[51] Int. Cl.[2] ..... F21M 7/00; F21V 21/00; H01R 33/74; H01J 9/18

[58] Field of Search ..... 240/41 BM, 52; 339/144 R, 144 T, 145 R, 145 D, 145 T, 184 L, 184 T, 186 T; 29/25.13

[56] References Cited

UNITED STATES PATENTS

| | | | |
|---|---|---|---|
| 2,082,954 | 6/1937 | Gustin | 29/25.13 |
| 3,516,042 | 6/1970 | Wagner | 339/144 T |
| 3,868,531 | 2/1975 | De Fraeye et al. | 339/144 |

OTHER PUBLICATIONS

E. Bright Wilson Jr., An Introduction to Scientific Research, 1952, McGraw-Hill Book Co., Inc., pp. 104–108.

*Primary Examiner*—George H. Miller, Jr.
*Attorney, Agent, or Firm*—Ernest W. Legree; Lawrence R. Kempton; Frank L. Neuhauser

[57] ABSTRACT

A prefocused single-ended lamp comprises a hollow ceramic base having an open side in which the lamp end is cemented and having three protrusions or bosses in the opposite side which is clamped to a fixture plate. The fixture plate provides six constraints to the bosses in order to fix the lamp in a stable kinematic mounting. The envelope is adjusted in the basing cement to place the lamp filament in a predetermined location and attitude relative to the fixture plate-engaging surfaces of the bosses. Such location and attitude are then reproducible with respect to similar fixture plates to an accuracy determined by the tolerance limits to which the fixture plates are machined.

10 Claims, 5 Drawing Figures

PREFOCUSED LAMP BASE AND FIXTURE

The invention relates generally to electric lamps and more particularly to a based single-ended lamp intended to cooperate with a fixture plate to accurately position the light source relative to an optical system and is a continuation-in-part of my copending application Ser. No. 506,179 filed Sept. 16, 1974, now abandoned.

BACKGROUND OF THE INVENTION

In certain lighting applications such as movie and slide projectors and photocopying machines, it is necessary that the light source be accurately located with respect to the optical system in order to illuminate evenly the material to be photographed and copied or to focus the light in the desired way.

A base frequently used for single-ended compact incandescent lamps such as tungsten-halogen quartz lamps is a hollow ceramic block open on one side wherein the lamp end is accommodated and set in basing cement, and having contact prongs projecting from the other side. In use of the lamp, the base is inserted into a socket attached to some part of the projector or copying machine, and is held in place by engagement of the prongs in cooperating sleeves of the socket. In some arrangements clamps are provided to prevent movement of the base as a result of vibration or jarring.

When the lamp is prefocused as part of the basing step in lamp manufacture, the base is seated in a socket or in a fixture simulating the socket and plastic cement is placed in the base cavity. The pressed end or neck of the bulb is seated in the cement and an image of the filament is reproduced by an optical system on an alignment chart. The basing operator moves the lamp as needed in the yet plastic cement until the filament image falls exactly on target, and the cement is allowed to harden. Notwithstanding these precautions, it has been found that severe variations in illumination occur when different lamps are exchanged in the same socket, or when the same lamp is transferred from socket to socket. In an optical system of condensers, lenses and reflectors, base misalignments of as little as 0.005 inch can result in severe variations in object illumination. Dimensional variations in the ceramic base which inevitably occur at molding or during firing frequently cause misalignments of such extent or greater.

SUMMARY OF THE INVENTION

The object of the invention is to provide a based lamp which can be prefocused and then combined with a fixture to achieve accurate alignment and which minimizes the effect of ceramic base variability upon the focusing, whereby the prefocused lamps are readily interchangeable.

The principle which I utilize is the same as is responsible for the stability of a three-legged table by comparison with a four-legged table. A four-legged table must be carefully made in order to stand on a level floor without rocking or sagging. However a three-legged table cannot rock, even without exacting workmanship, because it rests on the minimum number of supports. In accordance with the invention, the base which may be a ceramic block is provided with three protrusions or bosses in its bottom surface which are proportioned to achieve a kinematic mounting of the base on a suitable fixture plate to which it will be clamped in use. By a kinematic mounting is meant one which has the minimum number of restraints required for stability and thereby eliminates the need for exacting workmanship. When this is done, the base and the prefocused lamp cemented thereto will be located on different fixture plates with an accuracy which is dependent substantially only upon the accuracy of machining of the individual fixture plate, and not on the accuracy of molding of the ceramic bases.

A completely free rigid body may suffer displacement in three orthogonal directions and rotation about three perpendicular axes and is said to have 6° of freedom (or 12° when reverse displacement and rotation are considered). When the base block is held in contact with a flat plate, either by gravity or, as is necessary in practice, by clamping, the bosses make three point contacts which limit motion to sliding and rotation about an axis normal to the plate. A suitable fixture plate must provide three additional constraints in order to eliminate all relative movement. In one suitable arrangement, one boss is placed in a hole in the plate which provides the equivalent of three constraints, another may be placed in a slot providing two constraints, and the third may merely engage a flat surface to provide a single constraint. The base is then completely fixed relative to the fixture plate with six constraints. In an alternative arrangement, each one of the three bosses may be constrained by a groove or slot in the fixture plate, each providing the equivalent of two constraints or six in all.

In one preferred embodiment, the ceramic base has three generally conical protrusions in its bottom face, one of them truncated to a lesser height than the other two. The fixture plate has a hole and a slot in which the two cones are engaged, and the truncated cone butts up against the surface of the fixture plate. No matter what the variations in length, width and height of the base or in the distance between protrusions, when two protrusions are engaged in the slot and hole respectively, and the third is held against the top surface by suitable clamping means, the base is fully fixed relative to the fixture plate. Its mounting position or attitude will be identically repeated on any similar fixture plate within the tolerance limits of the plate. When the lamp is prefocused with respect to the base on this fixture plate, the based lamp becomes an interchangeable light source without need for readjusting the optics for any projection or copying system using a similar fixture plate.

DESCRIPTION OF THE PREFERRED EMBODIMENTS

Figure 1:
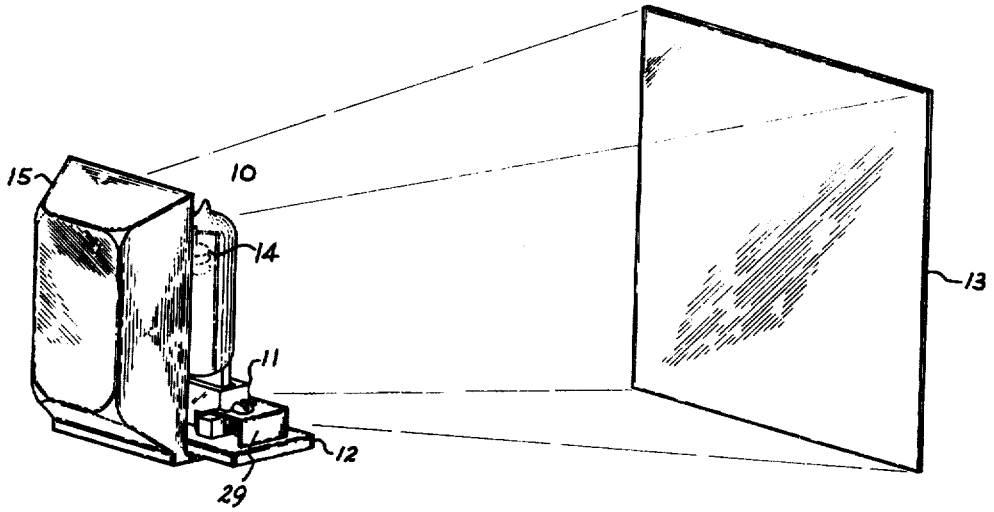
FIG. 1 is a perspective view of the lamp clamped to a fixture plate aligned with respect to a projection optical system.

Referring to FIG. 1 of the drawing, lamp 10 with base 11 of the invention is clamped to fixture plate 12 for projecting a light pattern on screen 13. The light source or concentrated energy translation means 14 of lamp 10 is thereby definitely located with respect to reflector 15 which focuses the light in a predetermined pattern on screen 13. The energy translation means may be any light source such as an incandescible filament or a discharge between electrodes. The optics of the projection system may contain various mirrors, reflectors and condensers, and reflector 15 is shown by way of example only.

Figure 2:
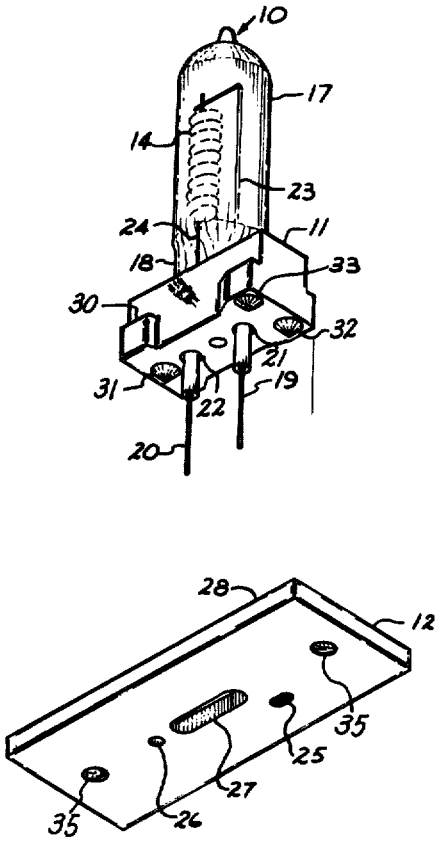
FIG. 2 is an exploded perspective view of the based lamp and plate prior to assembly.
Figure 3:
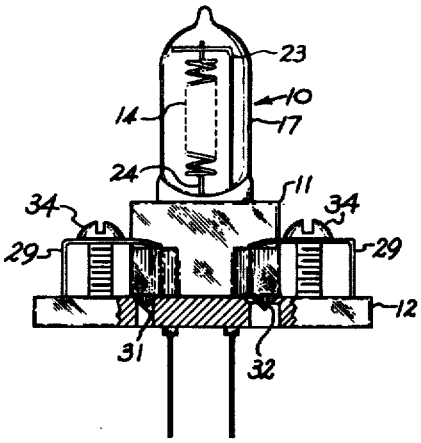
FIG. 3 is a front view showing how the protrusions nest in the hole and slot of the fixture plate.

As shown in greater detail in FIGS. 2 and 3, lamp 10 is comprised of light source 14, which in this case is a coiled-coil tungsten filament, lead wires, envelope or bulb 17 and pinch seal 18. The lead wires are made up of flexible insulated outer leads 19 and 20 which pass through holes 21, 22 in base 11, foil portions, not shown, which are sealed through the pinch seal or neck 18 of the bulb, and inner leads 23 and 24. Inner lead 23 may be of heavier wire than inner lead 24 and serves both as a power conductor and a support for the vertical tungsten filament. In a variant of the illustrated construction the larger inner lead may go up through the center of the coil so as to minimize any shadowing effect on the screen.

Envelope 17 may be filled with an inert gas such as nitrogen and a halogen such as bromine or iodine. By way of example only, the particular lamp shown is a 600-watt, 120 volt quartz-halogen lamp. It contains 99.7% nitrogen, 0.1% oxygen and 0.2% methyl bromide.

After the lamp bulb has been completed, that is pinch-sealed, filled with gas and tipped, it is mounted in base 11 and secured therein by high temperature basing cement. One suitable cement is known as 33 Sauereisen powder and is obtainable from Sauereisen Company, Pittsburgh, Pa. To prefocus light source 14 to its base, the base is clamped to a fixture plate and the bulb is shifted about in the basing cement while it is still plastic until the filament is located exactly at the design point relative to the fixture plate. Usually this is done with the help of an optical system which projects an image of the filament on an alignment chart. The basing cement is then heat-cured or is allowed to harden while maintaining the spatial relationship of bulb to base.

Equipment using the lamp of the invention has a projector or optical system accurately located at predetermined distances and angles with respect to the fixture plate. With that relationship fixed, the spatial relationship of the light source 14 to the position-determining surfaces of the fixture plate becomes critical. The invention allows this relationship to be maintained notwithstanding relatively gross dimensional variations in the base. Thus the invention permits prefocused interchangeable lamps to be made at relatively low cost.

The base 11 is generally made of a ceramic insulating material which is first molded to shape and then fired. Typically it has dimensional tolerances of ±0.005 inch. A misalignment of this magnitude can seriously affect the light pattern. However, conventional machining techniques will produce metal parts to dimensional tolerances of ±0.0005 inch. This is a ten-fold reduction and misalignments of this magnitude do not have an appreciable effect upon the lighting pattern. The fixture plate 12 is provided with a slot 25 and hole 26 machined to dimensional tolerances of ± 0.0005 inch. A slotted opening 27 is also provided through which the lead wires can extend but there is no contact at this opening and no need for machining to close tolerance. Slot 25 and hole 26 are chamfered at the upper surface of the plate at an angle equal to the angular profile of the conical projections on the base to distribute the bearing load of lamp and base on the plate to line contacts rather than higher stressed point contacts. The base is clamped against the plate by clips 29 having bifurcated ends (FIG. 5) which engage the side shoulders 30 of the base and which are held down by screws 34 engaging in tapped holes 35 in the plate. Since the position of the base on the fixture plate is determined by the engagement of the bosses or protrusions in hole 25 and slot 26 and the clips merely maintain the engagement, they need not be accurately made and the location of the tapped holes 35 is not critical.

Figure 4:
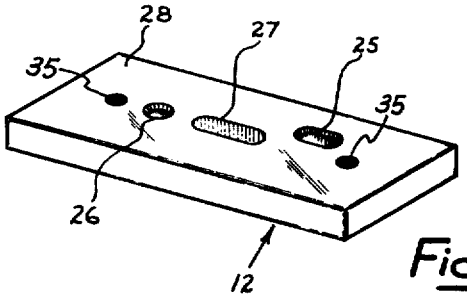
FIG. 4 is a perspective view of the fixture plate showing the chamfered hole and slot.

In the preferred embodiment illustrated in FIGS. 2 to 4, base 11 is provided with three generally cone-shaped protrusions 31, 32 and 33. Two of these protrusions, 31 and 32, are full cones of equal height while the third, 33, is truncated to a lesser height. Cone 31 is engaged in hole 26 to effect restraint against three degrees of freedom, cone 32 in slot 25 to effect restraint against 2° of freedom and truncated cone 33 merely rests on surface 28 to effect restraint against the last degree of freedom.

The engagements of the cones may be likened to point contacts and a kinematic mounting is effected utilizing the minimum number of restraints for stability, namely 6. Therefore, the base will be stably mounted on the fixture plate notwithstanding dimensional variations including variations in the distances between cones. Different bases will not necessarily sit in the identical attitude on the same fixture plate. But any one base will sit in an attitude that is repeated on different fixture plates to a degree of identity determined by the tolerances of the plate and not by the tolerances of the base. Since the bulb is prefocused in the individual bases while seated on a fixture plate, the prefocusing will be repeated in subsequent mountings with an accuracy determined by the fixture plates. Thus the quality of prefocusing is 10 times better with this arrangement than if it were made to depend on the accuracy of manufacture and the dimensional tolerances of the base itself.

Figure 5:
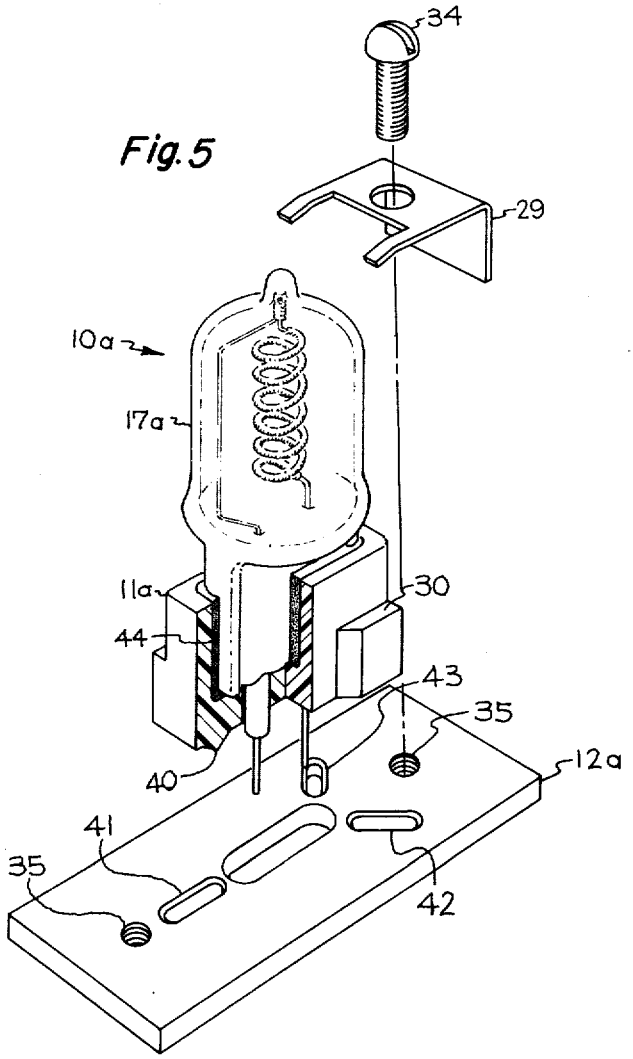
FIG. 5 is a perspective view of another based lamp with matching fixture plate forming a variant of the invention.

FIG. 5 illustrates another lamp **10*a* forming a variant of the invention and comprising a base 11*a* for clamping to a fixture plate 12*a*. The base is provided with three locating bosses which may be three substantially cone-shaped protrusions of identical height, one being seen at 40. The fixture plate is provided with three slots 41, 42 and 43 preferably chamfered in the upper surface and suitably arranged at 120° angular intervals. When the base is clamped to the fixture plate by clips 29 (one only being shown), each cone engages a slot and receives from the slot restraints against two degrees of freedom. The arrangement thus provides in a different way restraints against 6° of freedom, the minimum required for stability. The lamp is prefocused by adjusting the position of bulb 17*a* in basing cement 44 relative to base 11*a* while the base is clamped to fixture plate 12*a*.** By using similar plates having accurately machined slots in the equipments where the lamps are to be utilized, prefocused interchangeable lamps are obtained at relatively low cost.

What I claim as new and desire to secure by Letters Patent of the United States is:

1. A single-ended prefocused lamp comprising a sealed envelope containing concentrated energy translation means supplied by inleads hermetically sealed therein, and a base comprising a hollow body open on one side wherein an end of said envelope is accommodated and set in basing cement, said body having a side provided with three projecting bosses proportioned to contact a fixture plate and permit a stable kinematic mounting of said base thereon, said envelope end being adjusted in said basing cement to place said energy translation means in a predetermined location and attitude relative to the fixture plate engaging surfaces of said bosses whereby said location and attitude are reproducible with respect to similar fixture plates to an accuracy determined by the tolerance limits of the boss-engaging surfaces of said fixture plates.

2. A lamp as in claim 1 wherein two of said bosses are similar in height and geometry for engagement one in a hole and the other in a slot in the surface of said fixture plates, and the third of said bosses is of lesser height for engaging the surface of said fixture plates.

3. A lamp as in claim 1 wherein said three bosses are similar in height and geometry for engagement in three angled slots in the surface of said fixture plates.

4. A lamp as in claim 1 wherein the hollow body of the base is of ceramic material.

5. A lamp as in claim 1 wherein said bosses extend from the side of the base opposite the open side in which an end of said lamp is accommodated.

6. A lamp as in claim 5 wherein said base has an aperture in the side from which said bosses extend and said inleads extend through said aperture.

7. A lamp as in claim 6 wherein the hollow body of the base has lateral shoulders engageable by clips for clamping the base against the fixture plate.

8. In combination a single-ended prefocused lamp and a fixture plate, said lamp comprising a sealed envelope containing concentrated energy translation means supplied by inleads hermetically sealed therein, and a base comprising a hollow body open on one side wherein an end of said envelope is accommodated and set in basing cement, said body having a side provided with three projecting bosses proportioned to contact said fixture plate and permit a stable kinematic mounting of said base thereon, said envelope end being adjusted in said basing cement to place said energy translation means in a predetermined location and attitude relative to the fixture plate engaging surfaces of said bosses whereby said location and attitude are reproducible to an accuracy determined by the tolerance limits of the boss-engaging surfaces of said fixture plate.

9. A combination as in claim 8 wherein two of said bosses are similar in height and geometry for engagement one in a hole and the other in a slot in the surface of said fixture plate, and the third of said bosses is of lesser height for engaging the surface of said fixture plate.

10. A combination as in claim 8 wherein said three bosses are similar in height and geometry for engagement in three angled slots in the surface of said fixture plate.

* * * * *